US010900673B2

(12) United States Patent
Yonehara et al.

(10) Patent No.: US 10,900,673 B2
(45) Date of Patent: Jan. 26, 2021

(54) OUTDOOR UNIT FOR AN AIR-CONDITIONING APPARATUS

(71) Applicant: Mitsubishi Electric Corporation, Tokyo (JP)

(72) Inventors: Kentaro Yonehara, Tokyo (JP); Tatsuya Asanuma, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/316,664

(22) PCT Filed: Oct. 7, 2016

(86) PCT No.: PCT/JP2016/079979
§ 371 (c)(1),
(2) Date: Jan. 10, 2019

(87) PCT Pub. No.: WO2018/066127
PCT Pub. Date: Apr. 12, 2018

(65) Prior Publication Data

US 2019/0219279 A1 Jul. 18, 2019

(51) Int. Cl.
*F24F 1/56* (2011.01)
*F04D 29/70* (2006.01)
*F24F 13/20* (2006.01)

(52) U.S. Cl.
CPC ..... *F24F 1/56* (2013.01); *F04D 29/703* (2013.01); *F24F 13/20* (2013.01)

(58) Field of Classification Search
CPC ..... F24F 1/56; F24F 1/06; F24F 1/46; F24F 13/20; F04D 29/703
See application file for complete search history.

(56) References Cited

U.S. PATENT DOCUMENTS 5,221,180 A * 6/1993 Crider ..... F04D 29/703 403/11
5,474,427 A * 12/1995 Redetzke ..... F04D 29/703 415/121.2

(Continued)

FOREIGN PATENT DOCUMENTS

CN 2420554 Y 2/2001
CN 105091136 A 11/2015

(Continued)

OTHER PUBLICATIONS

Tranlstion of JP2014129920 (Year: 2014).*

(Continued)

*Primary Examiner* — Joseph F Trpisovsky
(74) *Attorney, Agent, or Firm* — Posz Law Group, PLC

(57) ABSTRACT

An outdoor unit for an air-conditioning apparatus includes: a casing having an opening portion of an air passage formed in a front panel; and a fan guard, which includes a plurality of vertical rails and a plurality of horizontal rails that are combined with each other, and is configured to cover the opening portion. The fan guard includes: an upper locking portion formed on an upper end portion of a vertical rail and lower locking portions formed on lower end portions of the vertical rails. The upper locking portion is formed by bending the upper end portion toward the casing side so as to be inclined downward. The lower locking portions are formed by bending toward the casing so that the distal ends are directed downward. The front panel has: upper and lower temporary fixing holes configured to receive the upper and lower locking portions to be inserted thereinto.

16 Claims, 8 Drawing Sheets

(56) References Cited

U.S. PATENT DOCUMENTS

| | | | | |
|---|---|---|---|---|
| 2010/0319380 | A1 | 12/2010 | Mochizuki et al. | |
| 2014/0154095 | A1 * | 6/2014 | Gonz Lez ..... | F24F 1/38<br>416/247 R |

FOREIGN PATENT DOCUMENTS

| | | | | |
|---|---|---|---|---|
| JP | H08-136003 | A | | 5/1996 |
| JP | H08-240327 | A | | 9/1996 |
| JP | 2000-055410 | A | | 2/2000 |
| JP | 2005-026321 | A | | 1/2005 |
| JP | 2005-180793 | A | | 7/2005 |
| JP | 2011-002167 | A | | 1/2011 |
| JP | 2011-094936 | A | | 5/2011 |
| JP | 2014129920 | A | * | 7/2014 |
| JP | 2015-034659 | A | | 2/2015 |

OTHER PUBLICATIONS

Extended European Search Report dated Aug. 20, 2019 issued in corresponding EP patent application No. 16918323.3.
International Search Report of the International Searching Authority dated Dec. 6, 2016 for the corresponding international application No. PCT/JP2016/079979 (and English translation).
Office Action dated May 7, 2020 issued in corresponding CN patent application No. 201680089803.6 (and English translation).

* cited by examiner

OUTDOOR UNIT FOR AN AIR-CONDITIONING APPARATUS

CROSS REFERENCE TO RELATED APPLICATION

This application is a U.S. national stage application of PCT/JP2016/079979 filed on Oct. 7, 2016, the contents of which are incorporated herein by reference.

TECHNICAL FIELD

The present invention relates to an outdoor unit for an air-conditioning apparatus, and more particularly, to a fixing structure of a fan guard, which is provided at an air-outlet opening portion of an air passage for sending air.

BACKGROUND ART

Hitherto, there has been disclosed an outdoor unit for an air-conditioning apparatus including a fan guard configured to cover an air-outlet opening portion of an air passage for sending air (see, for example, Patent Literature 1). The fan guard is provided, for example, so as to prevent a user from touching a rotating fan through the air-outlet opening portion.

According to Patent Literature 1, the outdoor unit includes: a front panel having an opening portion; eaves having first protrusions and being mounted to the front panel above the opening portion; and a fan guard mounted to the front panel. Under a state in which the eaves are mounted to the front panel, the first protrusions engage with a part of the fan guard to restrict downward movement of the fan guard. Further, the eaves have second protrusions that protrude toward a front side, and the fan guard is mounted to the front panel under a state in which the second protrusions are held in abutment with the fan guard so that a pressure toward the front side is applied to the fan guard. The fan guard is fixed in the following manner. A horizontal rail provided at an upper portion of the fan guard is caught on the first protrusions of the eaves. Bolts are inserted through bolt insertion holes formed in a lower portion of the fan guard, and are fastened to the front panel.

CITATION LIST

Patent Literature

Patent Literature 1: Japanese Unexamined Patent Application Publication No. 2015-34659 (FIG. 2)

SUMMARY OF INVENTION

Technical Problem

However, in the outdoor unit of Patent Literature 1, in order to perform temporary fixing before the fan guard is fixed with bolts, distal ends of vertical rails at the upper portion of the fan guard are inserted through temporary fixing holes of the front panel, and the horizontal rail provided at the upper portion of the fan guard is caught on the first protrusions formed on the eaves while the fan guard is held so as not to move toward the front. In this manner, the fan guard is temporarily fixed so as not to move downward. That is, it is required to provide a separate component such as the eaves so as to temporarily fix the fan guard. As a result, the outdoor unit of Patent Literature 1 requires a step of mounting the separate component, and there is a problem that the number of assembly steps is increased. Further, the distal ends of the vertical rails at the upper portion of the fan guard extend upward, and are inserted into the temporary fixing holes from below, and the horizontal rail of the fan guard is caught on the first protrusions from above. There is a problem that such structures cause also temporary fixing work to be difficult.

Further, after the fan guard is the temporarily fixed, it is required to fasten bolts. The outdoor unit of Patent Literature 1 has the bolt insertion holes at the lower portion of the fan guard, and hence bolt-fixing positions are located at a lower portion of the outdoor unit. Therefore, there is a problem that, when bolt fastening work is to be performed, an operator cannot visually recognize screw holes unless the operator stoops down so as to perform work, and hence workability is poor.

The present invention has been made to solve the problems mentioned above, and an object thereof is to provide an outdoor unit for an air-conditioning apparatus, which facilitates work for temporarily fixing a fan guard to a main body of the outdoor unit, and improves workability when the fan guard is to be fixed to the main body of the outdoor unit with bolts.

Solution to Problem

According to one embodiment of the present invention, there is provided an outdoor unit for an air-conditioning apparatus, comprising: a casing having an opening portion of an air passage formed in a front panel; and a fan guard, including a plurality of vertical rails and a plurality of horizontal rails that are combined with each other, and being configured to cover the opening portion, wherein the fan guard includes: an upper locking portion formed on an upper end portion of a vertical rail at one position at a center portion among the vertical rails, or formed on each of upper end portions of at least two vertical rails located so as to be separated away from each other in a right-and-left direction of the casing among the vertical rails; and lower locking portions formed on lower end portions of a plurality of vertical rails located so as to be separated away from each other in the right-and-left direction of the casing among the vertical rails, wherein the upper locking portion is formed by bending the upper end portion toward the casing so as to be inclined in a downward direction, wherein the lower locking portions are formed by bending the lower end portions toward the casing, and lower-locking-portion distal end portions being portions on distal ends of the lower locking portions are bent so that the distal ends are directed in the downward direction, and wherein the front panel has: an upper temporary fixing hole configured to receive the upper locking portion to be inserted thereinto and restrict movement of the fan guard in a forward direction; and a lower temporary fixing holes configured to receive the lower locking portions to be inserted thereinto and restrict movement of the fan guard in the forward direction and the downward direction.

Advantageous Effects of Invention

In the outdoor unit for an air-conditioning apparatus according to one embodiment of the present invention, with the above-mentioned configuration, the fan guard can be temporarily fixed by inserting the lower locking portions of the fan guard into the lower temporary fixing holes of the casing and thereafter inserting the upper locking portions into the upper temporary fixing hole. Thus, work can be easily performed, and the fan guard can be temporarily fixed to the casing in a stabilized manner. Further, the lower locking portions are inserted into the lower temporary fixing holes of the casing so as to be fixed. Thus, bolt-fixing positions of the fan guard can be set to an upper portion of the casing at which work is easily performed, rather than a lower portion of the casing.

DESCRIPTION OF EMBODIMENTS

Embodiment 1

Figure 1:
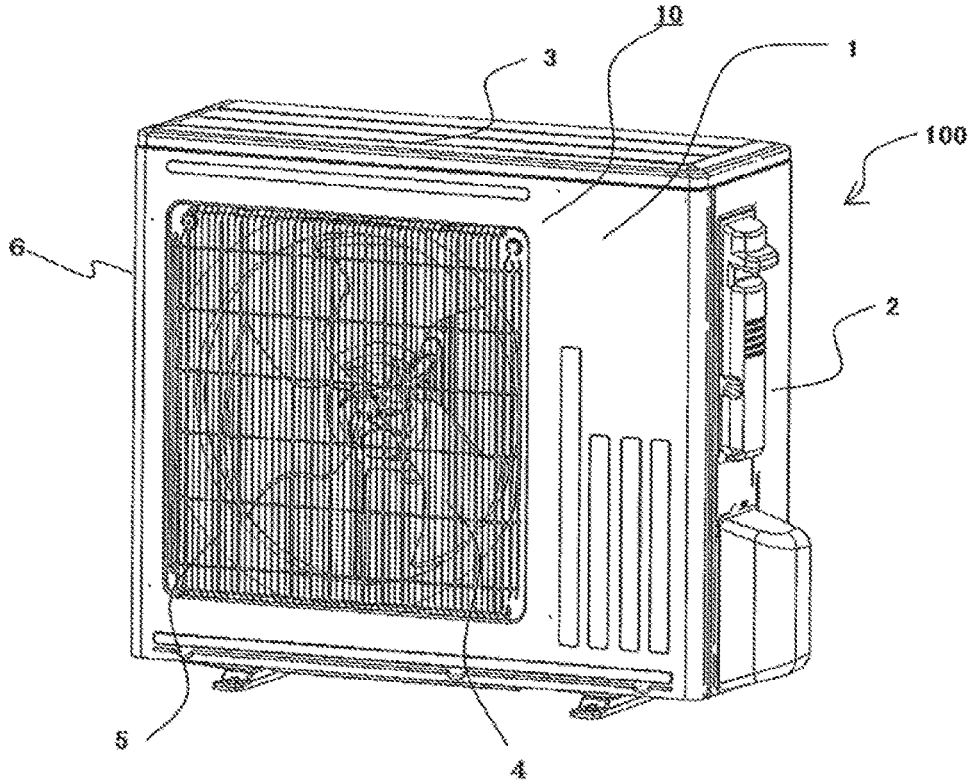
FIG. 1 is a perspective view of an outdoor unit for an air-conditioning apparatus according to Embodiment 1 of the present invention.

Now, an outdoor unit 100 for an air-conditioning apparatus according to an embodiment of the present invention is described. Note that, the embodiment illustrated in the drawings is merely an example, and should not be construed as limiting the scope of the present invention. Further, in the respective drawings, components denoted by the same reference symbols are the same or corresponding components. This applies throughout the entire specification. Still further, in the following drawings, the size relationship among the components often differs from the actual relationship.

<Overall Configuration of Outdoor Unit 100>

Figure 2:
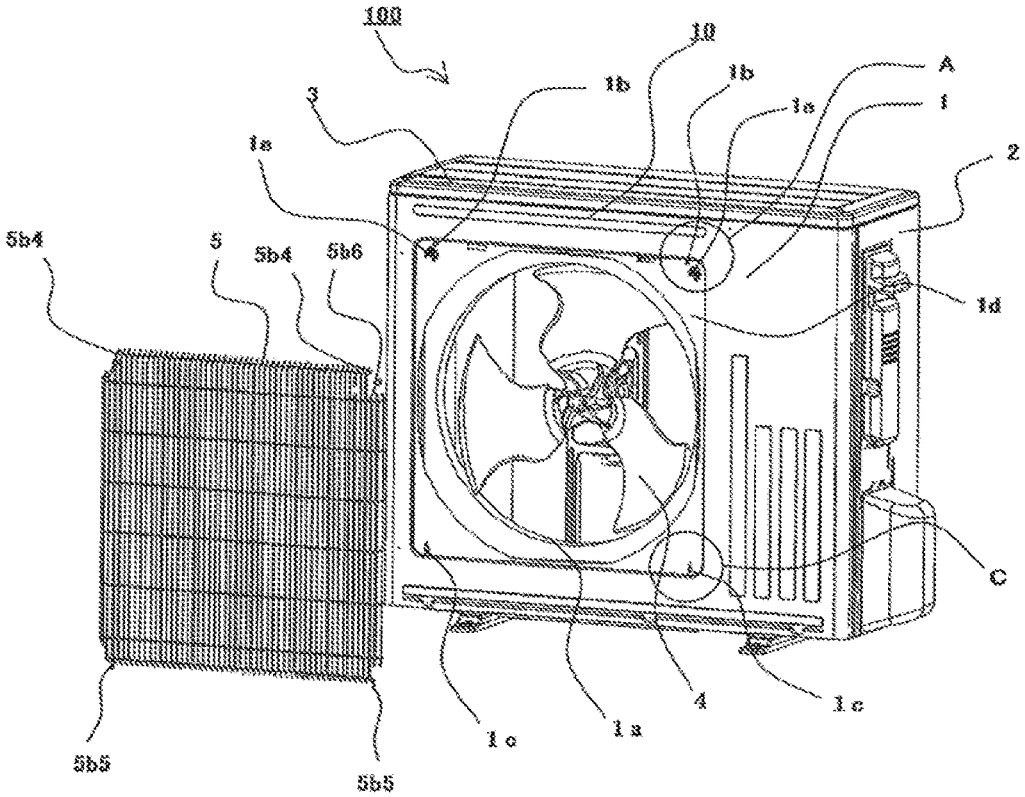
FIG. 2 is a perspective view illustrating a state in which a fan guard of the outdoor unit illustrated in FIG. 1 is removed.
Figure 3:
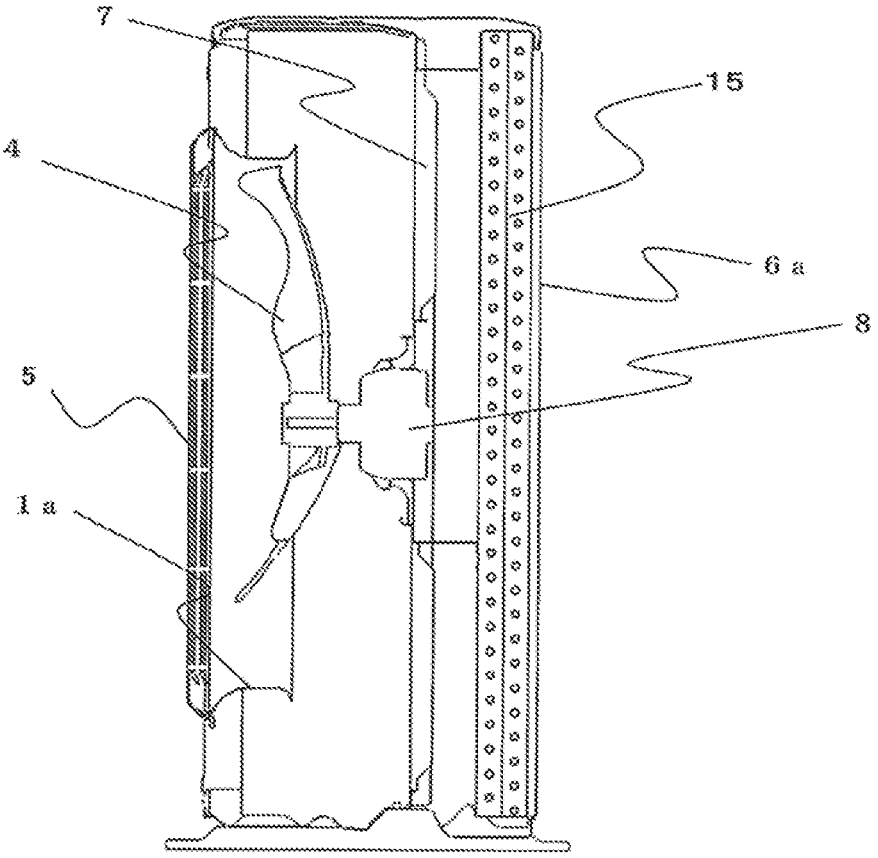
FIG. 3 is an explanatory view of a vertical cross section including a center axis of a fan in FIG. 1.

FIG. 1 is a perspective view of an outdoor unit 100 for an air-conditioning apparatus according to Embodiment 1 of the present invention. FIG. 2 is a perspective view illustrating a state in which a fan guard 5 of the outdoor unit 100 illustrated in FIG. 1 is removed. FIG. 3 is an explanatory view of a vertical cross section including a central axis of a fan in FIG. 1.

The outdoor unit 100 includes, for example, a substantially cuboid casing 10. That is, as illustrated in FIG. 1, the outdoor unit 100 includes a front panel 1, a side panel 2, and a top panel 3. The front panel 1 forms a front surface of the casing 10 of the outdoor unit 100. The side panel 2 forms a side surface of the casing 10. The top panel 3 forms a top surface of the casing 10. Further, the outdoor unit 100 includes a rear panel 6 forming a rear surface and a side surface, which is opposed to the side panel 2, of the casing 10. The rear panel 6 has an air inlet 6*a* for taking air into the outdoor unit 100. The front panel 1 of the outdoor unit 100 has an opening portion 1*a* for discharging air to an outside. A front surface of the opening portion 1*a* is covered with the fan guard 5 from an outer side of the casing 10. The configuration of the casing 10 of the outdoor unit 100 is not limited to the configuration described above, and may suitably be changed. The panels such as the front panel 1 forming the casing 10 of the outdoor unit 100 may be integrally formed in combination. Further, each panel may further be formed of a plurality of separate panels. In the following description, a side on which the front panel 1 of the casing 10 is arranged is referred to as "front side". A side closer to the rear panel 6 that is opposed to the front panel 1 in the casing 10 is referred to as "rear side". Right and left directions of the front panel 1 of the casing 10 are referred to as "right side" and "left side", respectively. Further, a side closer to the top panel 3 of the casing 10 is referred to as "upper side". A side on which a surface of the casing 10, which is opposed to the top panel 3, is located is referred to as "lower side".

As illustrated in FIG. 3, a fan 4 is installed inside the opening portion 1*a* of the front panel 1. A motor 8 is mounted to a central portion of the fan 4. The motor 8 is mounted to a fixing member 7 installed inside the casing 10. A heat exchanger 15 is arranged on a part closer to the rear panel 6 of the fan 4 and the motor 8. An air inlet 6*a* of the rear panel 6 is opened along the heat exchanger 15. When the fan 4 is driven to rotate by the motor 8, outdoor air flows in through the air inlet 6*a*, and is guided to the inside from the rear surface side of the casing 10. Then, the air having exchanged heat with refrigerant by the heat exchanger 15 is blown out from the opening portion 1*a*.

<Configuration of Front Panel 1>

As illustrated in FIG. 2, at a central portion of the front panel 1, there is formed the opening portion 1*a* for allowing the air having exchanged heat to blow out. A rectangular recess is formed in a periphery of the opening portion 1*a* as viewed from the front surface side of the casing 10, and the recess serves as a fan-guard mounting portion 1*d*. The fan guard 5 is mounted to an inner side of the fan-guard mounting portion 1*d*. Upper temporary fixing holes 1*b* for temporarily fixing the fan guard 5 are formed at two positions on upper right and left sides relative to the opening portion 1*a* when seeing the front panel 1 ahead. Further, lower temporary fixing holes 1*c* are formed at two positions on lower right and left sides relative to the opening portion 1*a*. The upper temporary fixing holes 1*b* and the lower temporary fixing holes 1*c* are formed at positions bilaterally symmetrical to each other relative to the center of the opening portion 1*a*. Further, bolt holes 1*e* are formed in the vicinities of the upper temporary fixing holes 1*b*, respectively. The bolt holes 1*e* are located on right and left outer sides of the upper temporary fixing holes 1*b* relative to the opening portion 1*a* as the center.

Figure 4:
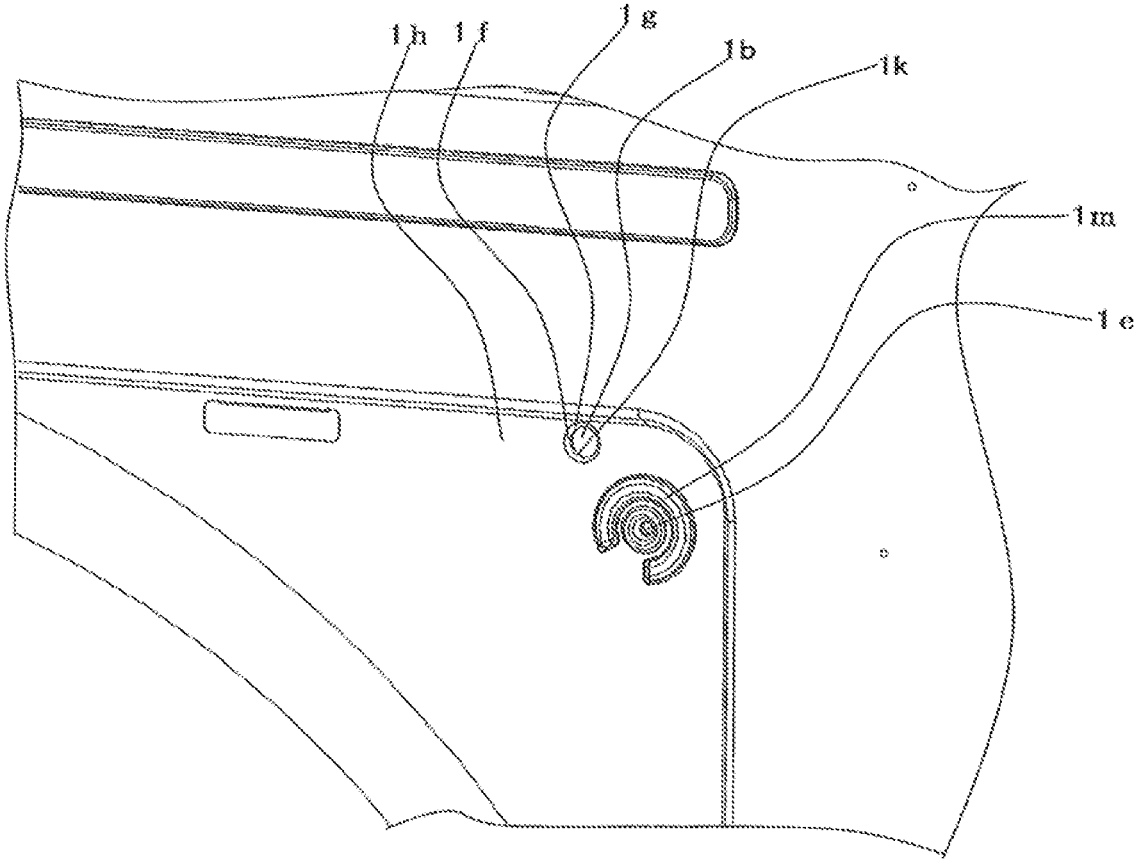
FIG. 4 is an enlarged view of the portion A in FIG. 2.

FIG. 4 is an enlarged view of the portion A in FIG. 2. FIG. 4 is an enlarged illustration of a periphery of the upper temporary fixing hole 1*b* on an upper right side when seeing the front panel 1 of the casing 10 ahead. A periphery of the upper temporary fixing hole 1*b* on an upper left when seeing the front panel 1 of the casing 10 ahead corresponds to a structure formed so as to be bilaterally symmetrical to the structure of the periphery of the upper temporary fixing hole 1*b* in FIG. 4. The upper temporary fixing hole 1*b* is opened in a direction perpendicular to a front surface 1*h* of the front panel 1, that is, opened so as to be directed toward the front side of the casing 10. A curved surface if is formed on an edge portion 1*g* of the upper temporary fixing hole 1*b*, and is smoothly continued to the front surface 1*h* of the front panel 1. Further, a cylindrical portion 1*k* is formed on the edge portion 1*g* of the upper temporary fixing hole 1*b*. The cylindrical portion 1*k* is upright from the front surface toward the inner side of the casing 10. In Embodiment 1, the front panel 1 is formed, for example, through plastic deformation of a sheet metal. The upper temporary fixing holes 1*b* in the front panel 1 are formed, for example, by burring.

The bolt hole 1*e* is formed on a lower right side of the upper temporary fixing hole 1*b*. The bolt hole 1*e* is also opened so as to be directed toward the front side of the casing 10. Further, a protruding portion 1*m* is formed so as to surround the bolt hole 1*e*. The protruding portion 1*m* is formed, for example, through press forming of the front surface 1*h* of the front panel 1.

Figure 5:
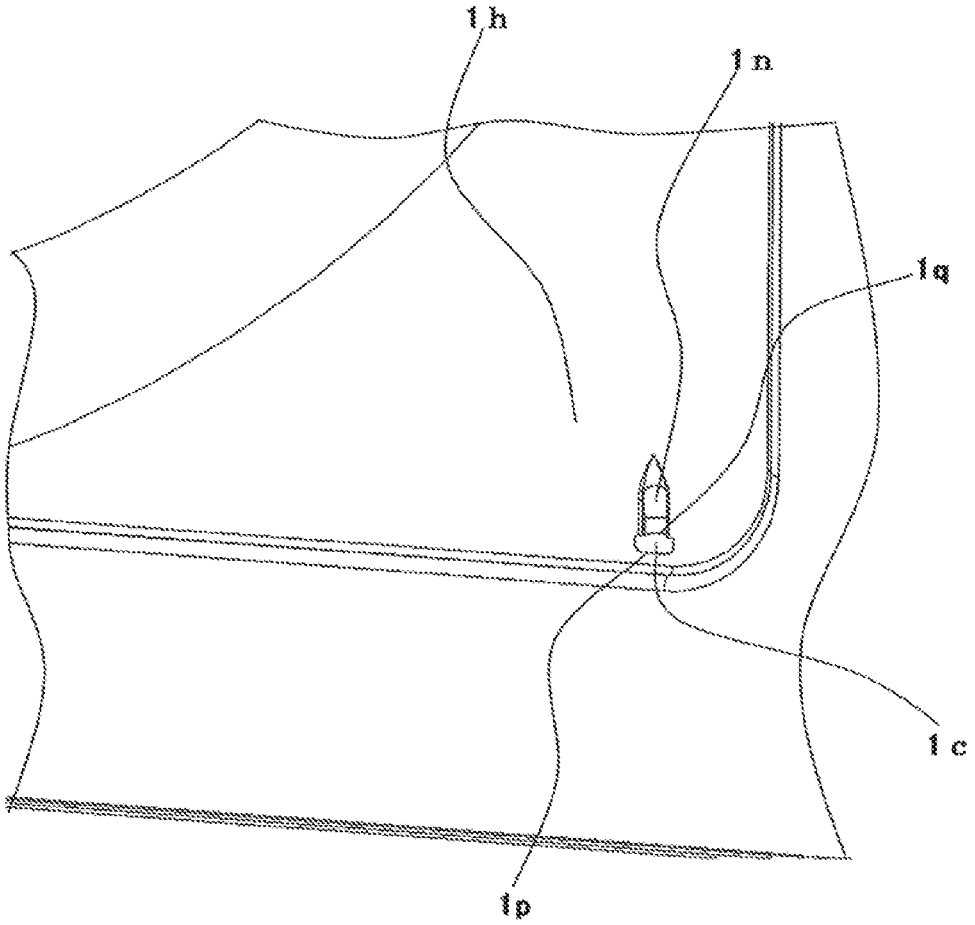
FIG. 5 is an enlarged view of the portion B in FIG. 2.

FIG. 5 is an enlarged view of the portion B in FIG. 2. FIG. 5 is an enlarged illustration of a periphery of the lower temporary fixing hole 1*c* on a lower right side when seeing the front panel 1 of the casing 10 ahead. A periphery of the lower temporary fixing hole 1*c* on a lower left side when seeing the front panel 1 of the casing 10 ahead corresponds to a structure formed so as to be bilaterally symmetrical to the structure of the periphery of the lower temporary fixing hole 1*c* in FIG. 5. The lower temporary fixing hole 1*c* is formed so as to be opened at a lower end portion of a groove 1*n*, which is formed in the front surface 1*h* of the front panel and is elongated in an up-and-down direction of the casing 10. With this configuration, a lower edge portion 1*p* located on a lower side of the lower temporary fixing hole 1*c* is located on the front side relative to an upper edge portion 1*q* located on an upper side of the lower temporary fixing hole 1*c*. That is, the lower edge portion 1*p* is located on the front side of the casing 10 relative to the upper edge portion 1*q*, and the upper edge portion 1*q* is located on the inner side of the casing 10, that is, the rear side relative to the lower edge portion 1*p*. Therefore, the lower temporary fixing hole 1*c* is a hole opened so as to be directed in an upward direction of the casing 10.

<Configuration of Fan Guard 5>

Figure 6:
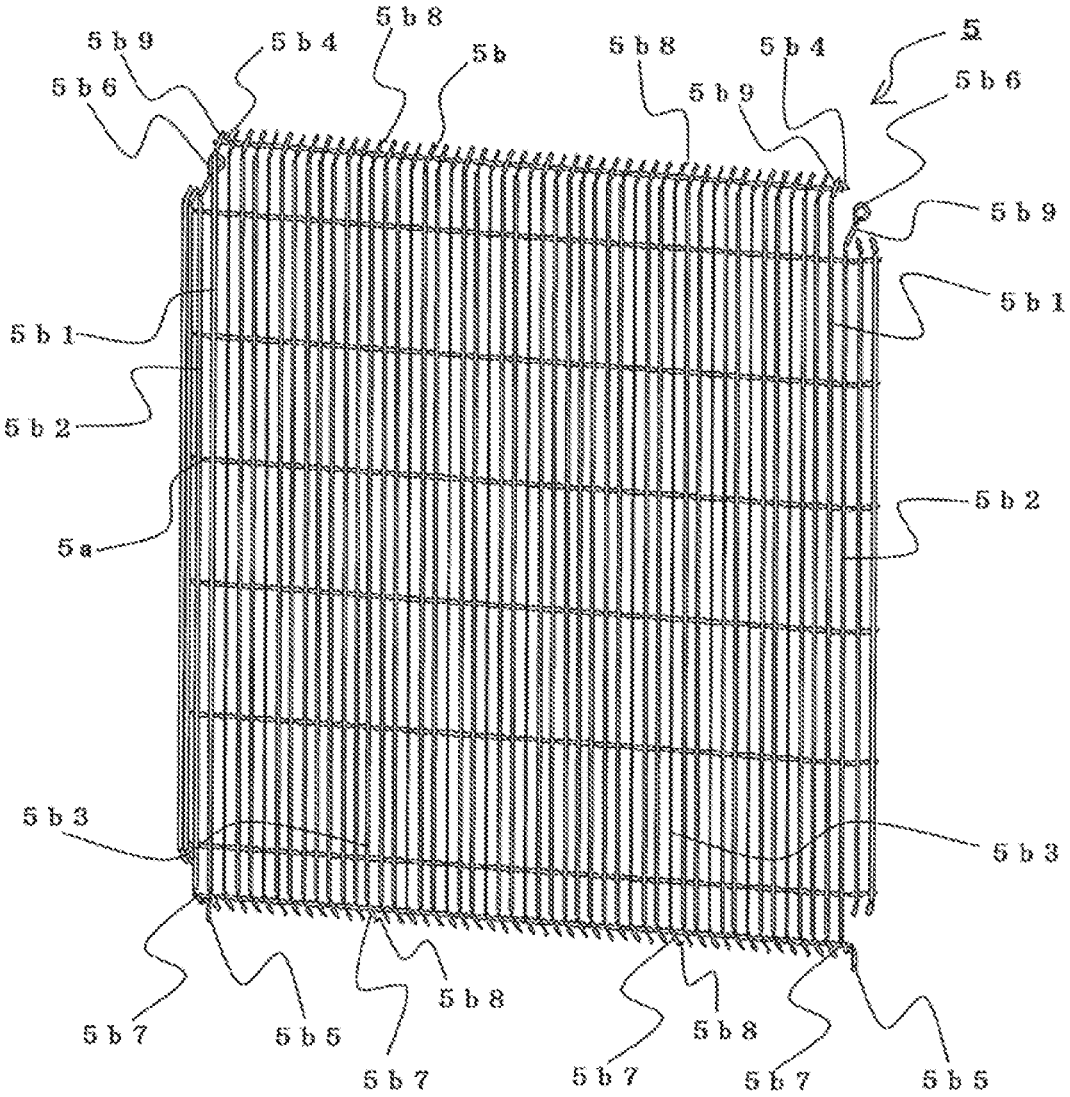
FIG. 6 is a perspective view of the fan guard in FIG. 1.

FIG. 6 is a perspective view of the fan guard 5 in FIG. 1. As illustrated in FIG. 6, the fan guard 5 includes horizontal rails 5*a* and vertical rails 5*b* that are combined with each other. The horizontal rails 5*a* and the vertical rails 5*b* are each formed of, for example, a wire member. A plurality of horizontal rails 5*a* are arranged in the up-and-down direction of the casing 10 at predetermined intervals, and each are a rail provided so as to extend in the right-and-left direction of the casing 10. A plurality of vertical rails 5*b* are arranged in the right-and-left direction of the casing 10 at predetermined intervals, and each are a rail provided so as to extend in the up-and-down direction of the casing 10. That is, the horizontal rails 5*a* and the vertical rails 5*b* are provided so as to intersect with each other in directions orthogonal to each other. The fan guard 5 includes first vertical rails 5*b*1 and second vertical rails 5*b*2. The first vertical rails 5*b*1 are arranged at two positions separated away from each other in the right-and-left direction of the casing 10. Upper end portions 5*b*9 of the first vertical rails 5*b*1 are bent toward the casing 10 to form upper locking portions 5*b*4. Under a state in which the fan guard 5 is mounted to the front panel 1, the upper locking portions 5*b*4 are inserted into the upper temporary fixing holes 1*b* of the front panel 1.

The second vertical rails 5*b*2 are also arranged at two positions separated away from each other in the right-and-left direction of the casing 10. Upper end portions 5*b*9 of the second vertical rails 5*b*2 are bent toward the casing 10. Distal end portions of the upper end portions 5*b*9 of the second vertical rails 5*b*2 each have a bolt insertion portion 5*b*6 which is formed by bending the wire member into a circular shape. The bolt insertion portions 5*b*6 each have a hole opened in a front-and-rear direction of the casing 10 so that a bolt can be inserted in the front-and-rear direction of the casing 10.

Further, lower end portions 5*b*7 of the second vertical rails 5*b*2 are bent toward the casing 10, and lower-locking-portion distal end portions 5*b*10 being portions on further distal ends of the lower end portions 5*b*7 are bent in a downward direction to form lower locking portions 5*b*5. Under the state in which the fan guard 5 is mounted to the front panel 1, the lower locking portions 5*b*5 are inserted into the lower temporary fixing holes 1*c* of the front panel 1. The bolt insertion portion 5*b*6 and the lower locking portion 5*b*5 are formed on each of the second vertical rails 5*b*2. However, the bolt insertion portion 5*b*6 and the lower locking portion 5*b*5 may be formed on vertical rails 5*b* different from each other.

Further, the fan guard 5 includes third vertical rails 5*b*3. The third vertical rails 5*b*3 are arranged at two positions separated away from each other in the right-and-left direction of the casing 10. The third vertical rails 5*b*3 are arranged on the central side relative to the first vertical rails 5*b*1 and the second vertical rails 5*b*2, that is, arranged closer to the center of the fan 4. An upper end portion 5*b*9 and a lower end portion 5*b*7 of each of the third vertical rails 5*b*3 are bent toward the casing 10, and distal ends of the upper end portion 5*b*9 and the lower end portion 5*b*7 are directed so as to be substantially perpendicular to the front surface 1*h* of the front panel 1 of the casing 10. The distal ends of the upper end portion 5*b*9 and the lower end portion 5*b*7 of each of the third vertical rails 5*b*3 are abutment portions 5*b*8 to be held in abutment with the front surface 1*h* of the front panel 1.

The specific numbers of the horizontal rails 5*a* and the vertical rails 5*b* are not limited to the numbers illustrated in the drawings. Further, the positions of the first vertical rails 5*b*1, the second vertical rails 5*b*2, and the third vertical rails 5*b*3 are not limited to the positions illustrated in the drawings. The number of the positions at which the first vertical rails 5*b*1 are arranged is not limited to two. The first vertical rail 5*b*1 may be arranged at one position at the central portion in the right-and-left direction of the casing 10, or the first vertical rails 5*b*1 may be arranged at three or more positions. The number of the positions at which the second vertical rails 5*b*2 are arranged is also not limited to two. The second vertical rails 5*b*2 may be arranged at three or more positions. The number of the positions at which the third vertical rails 5*b*3 are arranged is also not limited to two. The third vertical rail 5*b*3 may be arranged at one position at the central portion, or the third vertical rails 5*b*3 may be arranged at three or more positions. However, it is desired that the first vertical rails 5*b*1, the second vertical rails 5*b*2, and the third vertical rails 5*b*3 be arranged equally in the right-and-left direction across the center of the fan guard 5. Further, the fan guard 5 may be made of resin instead of metal wires.

Figure 7:
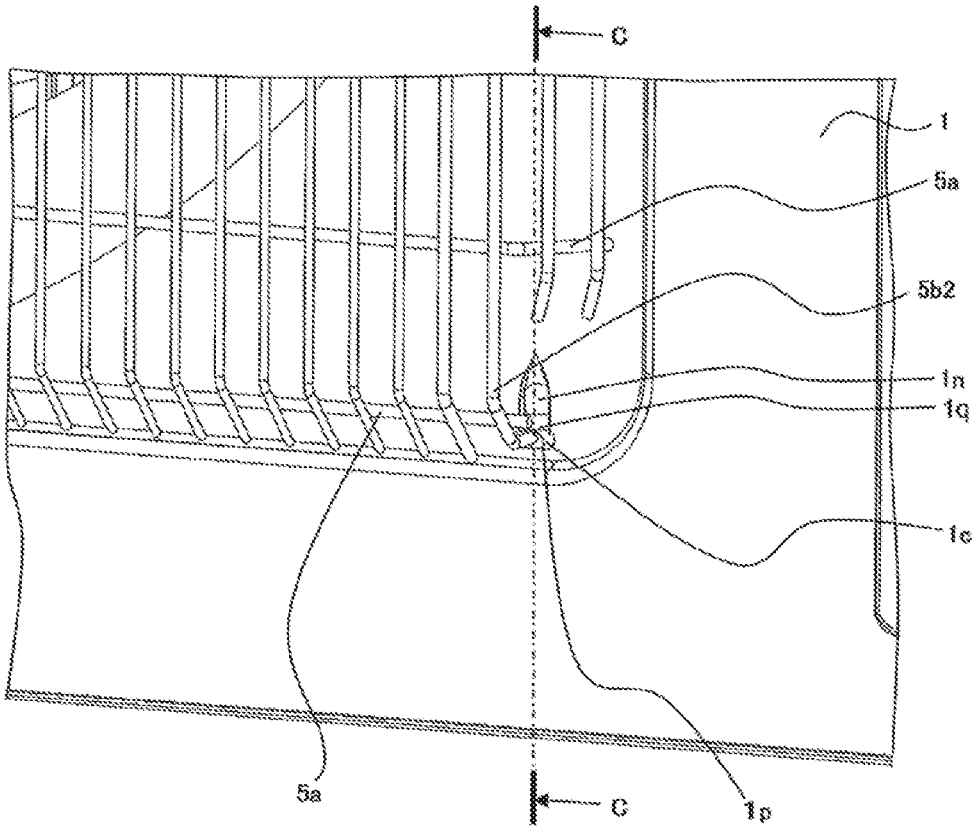
FIG. 7 is an enlarged view illustrating a periphery of a lower locking portion of the fan guard of the outdoor unit in Embodiment 1 of the present invention.
Figure 8:
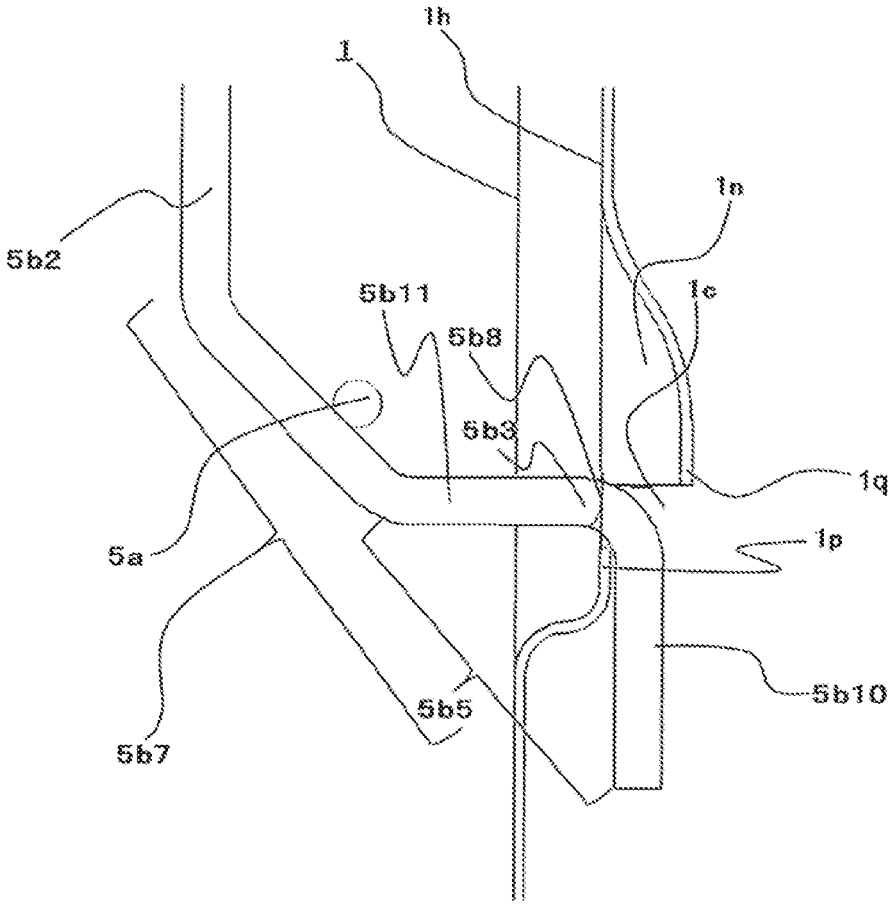
FIG. 8 is an explanatory view of a cross section taken along line C-C in FIG. 7.

FIG. 7 is an enlarged view illustrating a periphery of the lower locking portion 5*b*5 of the fan guard 5 of the outdoor unit 100 in Embodiment 1 of the present invention. FIG. 8 is an explanatory view of a cross section taken along line C-C in FIG. 7. The cross section taken along line C-C is a cross section taken by cutting the casing 10 in the front-and-rear direction, and is a cross section passing through the center of the lower temporary fixing hole 1*c*. Under the state in which the fan guard 5 is fixed to the front panel 1, the lower-locking-portion distal end portion 5*b*10 being the portion on the distal end of the lower locking portion 5*b*5 is located on the inner side of the casing 10, and is arranged in substantially parallel to the front surface 1*h* of the front panel 1 while a distal end thereof is directed downward. Further, the lower-locking-portion distal end portion 5*b*10 is located on the rear side relative to the lower edge portion 1*p* of the lower temporary fixing hole 1*c*, which is located on the lower side in the casing 10, and is located on the front side relative to the upper edge portion 1*q* located on the upper side in the casing 10. With such configuration, the lower-locking-portion distal end portion 5*b*10 is held in abutment with the lower edge portion 1*p* to restrict movement of the fan guard 5 toward the front side of the casing 10. Further, the portion indicated by the dotted line in FIG. 8 denotes the third vertical rail 5*b*3 located on a far side relative to the second vertical rail 5*b*2 in FIG. 8, specifically, denotes the abutment portion 5*b*8 at the distal end of the lower end portion 5*b*7 of the third vertical rail 5*b*3. The abutment portion 5*b*8 is held in abutment with the front surface 1*h* of the front panel 1 to restrict movement of the fan guard 5 toward the rear side of the casing 10. That is, the lower-locking-portion distal end portion 5*b*10 and the abutment portion 5*b*8 are held in abutment with the front panel 1 to restrict movement of the fan guard 5 in the front-and-rear direction of the casing 10.

Further, a horizontal portion 5*b*11 of the lower locking portion 5*b*5, which is bent in the direction perpendicular to the front surface 1*h* of the front panel 1, is located above the lower edge portion 1*p* of the lower temporary fixing hole 1*c*, and is held in abutment with the lower edge portion 1*p* to restrict movement of the fan guard 5 in the downward direction.

Figure 9:
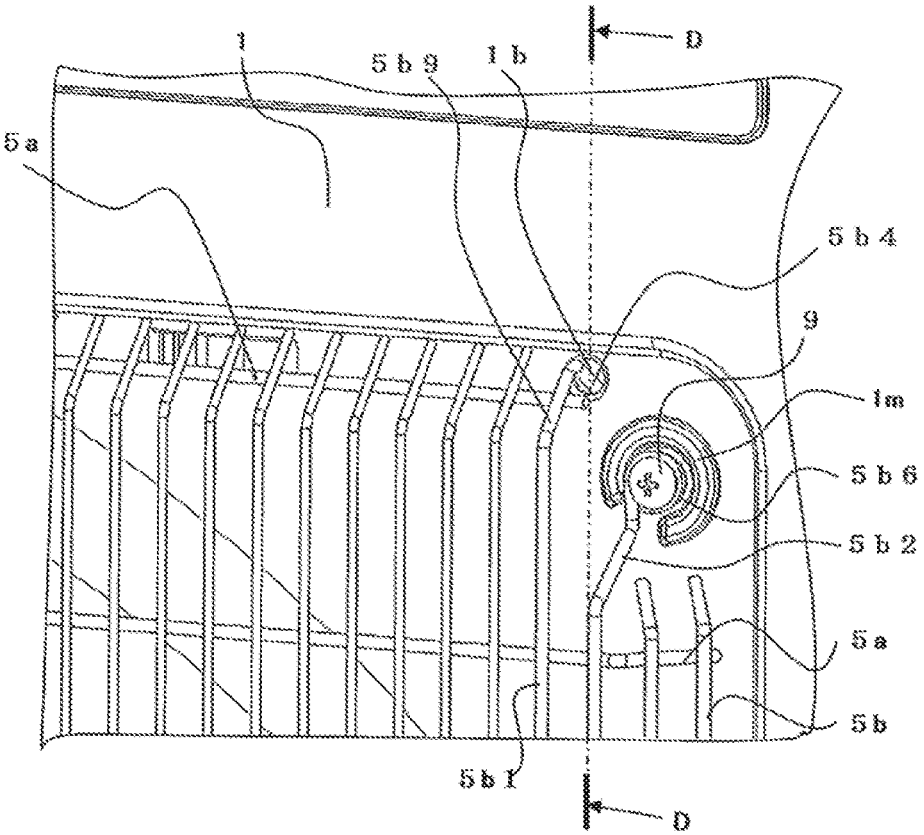
FIG. 9 is an enlarged view illustrating a periphery of an upper locking portion of the fan guard of the outdoor unit in Embodiment 1 of the present invention.
Figure 10:
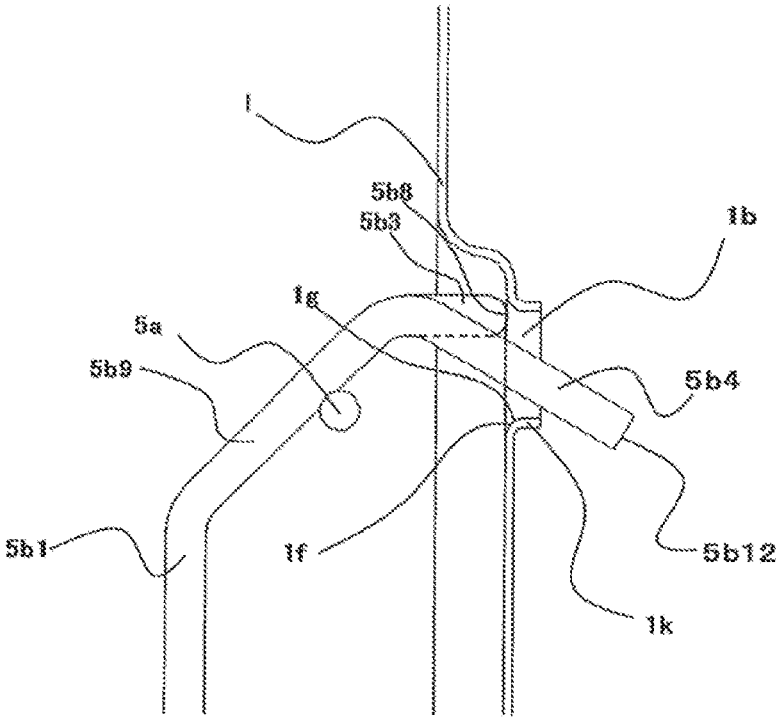
FIG. 10 is an explanatory view of a cross section taken along line D-D in FIG. 9.

FIG. 9 is an enlarged view illustrating a periphery of the upper locking portion 5*b*4 of the fan guard 5 of the outdoor unit 100 in Embodiment 1 of the present invention. FIG. 10 is an explanatory view of a cross section taken along line D-D in FIG. 9. The cross section taken along line D-D is a cross section taken by cutting the casing 10 in the front-and-rear direction, and is a cross section passing through the center of the upper temporary fixing hole 1*b*. As illustrated in FIG. 10, under the state in which the fan guard 5 is fixed to the front panel 1, a distal end 5*b*12 of the upper locking portion 5*b*4 is located on the inner side of the casing 10, and is directed in an obliquely downward direction. Further, the distal end 5*b*12 is located at the same height as or below a lower end of the upper temporary fixing hole 1*b*, and is caught on the end portion of the cylindrical portion 1*k* of the upper temporary fixing hole 1*b* on the inner side of the casing 10 when the fan guard 5 is moved in a direction in which the fan guard 5 is to be removed from the upper temporary fixing hole 1*b*.

With this configuration, in a temporarily fixed state before the fan guard 5 is fixed to the casing 10 with bolts, movement of the fan guard 5 toward the front side of the casing 10 is restricted.

Further, as illustrated in FIG. 9, the fan guard 5 is fastened in such a manner that a bolt 9 is inserted into the bolt insertion portion 5*b*6 formed on the second vertical rail 5*b*2, and the bolt 9 is screwed with the front panel 1. The fan guard 5 is fastened with the bolt 9 to be restricted in movement in the front-and-rear direction of the casing 10. The bolt insertion portion 5*b*6 is arranged so as to be surrounded by the protruding portion 1*m* that protrudes from the front surface 1*h* of the front panel 1, and is positioned in the up-and-down direction and the right-and-left direction relative to the bolt hole 1*e*.

Further, the third vertical rail 5*b*3 illustrated in FIG. 10 is located on a far side relative to the first vertical rail 5*b*1. The abutment portion 5*b*8 at the distal end of the upper end portion 5*b*9 of the third vertical rail 5*b*3 is held in abutment with the front surface 1*h* of the front panel 1. Under the state in which the fan guard 5 is fixed with bolts, the abutment portion 5*b*8 has a function of suppressing vibration of the fan guard 5 during an operation of the outdoor unit 100 in such a manner that the abutment portion 5*b*8 is held in abutment with the front surface 1*h* of the front panel 1 at a position away from the bolt-fixing position.

<Mounting Procedure for Fan Guard 5>

In the fan guard 5, under the state in which the upper locking portions 5*b*4 are located on the upper side and the lower locking portions 5*b*5 are located on the lower side, first, the lower locking portions 5*b*5 are inserted into the lower temporary fixing holes 1*c*. At this time, in the fan guard 5, under the state in which the upper end portions 5*b*9 are inclined toward the front side of the casing 10, the lower-locking-portion distal end portions 5*b*10 of the lower locking portions 5*b*5 are inserted into the lower temporary fixing holes 1*c* of the casing 10. After the lower-locking-portion distal end portions 5*b*10 are inserted into the lower temporary fixing holes 1*c*, the upper end portions 5*b*9 of the fan guard 5, which are inclined toward the front side of the casing 10, are brought closer to the front panel 1 of the casing 10 with the lower locking portions 5*b*5 as support points. The lower locking portions 5*b*5 are restricted in movement in the front-and-rear direction and the downward direction by the lower edge portions 1*p* of the lower temporary fixing holes 1*c*. Therefore, as the upper locking portions 5*b*4 are brought closer to the upper temporary fixing holes 1*b*, the upper locking portions 5*b*4 spontaneously match in position with the upper temporary fixing holes 1*b*. Under the temporarily fixed state, the distal ends 5*b*12 of the upper locking portions 5*b*4 are located at the same height level as or below the lower ends of the upper temporary fixing holes 1*b*. Therefore, when the fan guard 5 is pushed toward the front panel 1, the upper locking portions 5*b*4 are inserted into the upper temporary fixing holes 1*b* while being held in abutment with the edge portions 1*g* on the lower sides of the upper temporary fixing holes 1*b*.

In FIG. 10, the distal end 5*b*12 of the upper locking portion 5*b*4 is illustrated as being flat. However, actually, an edge at the end surface of the distal end 5*b*12 may be formed to be rounded. In the fan guard 5, wire materials forming the horizontal rails 5*a* and the vertical rails 5*b* are coated. For example, powder of a coating material such as polypropylene is adhered to the entire front surface of the fan guard 5 due to static electricity, and is heated at high temperature so that the powder of polypropylene is molten to be firmly fixed to the entire front surface of the fan guard 5. With this configuration, the entire fan guard 5 including the distal ends 5*b*12 of the upper locking portions 5*b*4 is covered by the coating material such as polypropylene. The distal ends 5*b*12 are covered with the molten coating material so that the edges at the end portions are rounded. With this configuration, when the upper locking portions 5*b*4 are to be inserted into the upper temporary fixing holes 1*b*, it is possible to prevent damage to the front surface 1*h*, the edge portions 1*g*, and the cylindrical portions 1*k* of the front panel 1, against which the distal ends 5*b*12 are to be brought into abutment. Further, the coating on the front panel 1 is not peeled off, thereby being capable of preventing corrosion at a portion at which the coating is peeled off.

Further, as illustrated in FIG. 10, the edge portion 1*g* of the upper temporary fixing hole 1*b* is formed of the curved surface 1*f*. Therefore, the distal ends 5*b*12 of the upper locking portions 5*b*4 of the fan guard 5 can be inserted along the curved surfaces 1*f* of the edge portions 1*g*. Thus, the insertion is facilitated, and temporary fixing work for the fan guard 5 is facilitated. Further, the cylindrical portions 1*k* are upright on the edge portions 1*g* of the upper temporary fixing holes 1*b* toward the inner side of the casing 10. Thus, strength of the periphery of each of the upper temporary fixing holes 1*b* is higher than in a case of a shape in which a hole is punched out in a flat sheet. With this configuration, when the distal ends 5*b*12 of the upper locking portions 5*b*4 of the fan guard 5 are to be inserted into the upper temporary fixing holes 1*b*, the peripheries of the upper temporary fixing holes 1*b* are not deformed. Further, stiffness of the periphery of each of the upper temporary fixing holes 1*b* is high. Thus, a part nearer to the fan guard 5 is easily elastically deformed, and hence is easily warped. Accordingly, there is an advantage that the upper locking portions 5*b*4 are easily inserted.

When the upper locking portions 5*b*4 of the fan guard 5 are inserted into the upper temporary fixing holes 1*b*, the upper locking portions 5*b*4 of the fan guard 5 are caught on the upper temporary fixing holes 1*b* so that the fan guard 5 is not tilted toward the front side of the casing 10. Therefore, a state in which the fan guard 5 is assembled to the front panel 1 can be kept even when an operator does not hold the fan guard 5 by, for example, a hand. The fan guard 5 is fixed to the front panel 1 in such a manner that, under the temporarily fixed state, the bolts 9 are inserted into the bolt insertion portions 5*b*6, and the bolts 9 are fastened to the bolt holes 1*e* formed in the front panel 1. The fixing of the fan guard 5 is not limited to the fixing with bolts as mentioned above. For example, the fan guard 5 and the front panel 1 may be fixed to each other by, for example, caulking.

The temporary fixing holes for the fan guard 5 may be formed so as to be vertically inverted. In this case, the fan guard 5 is assembled to the casing 10 while being vertically inverted. For example, when the outdoor unit 100 has a large size, and the bolt holes 1*e* formed at the upper portions are located at the high positions so that an operator is difficult to perform fastening work for the bolts 9, it is effective to employ the vertically inverted structure.

Effect of Embodiment (1) The outdoor unit 100 for an air-conditioning apparatus according to Embodiment 1 includes the casing 10 and the fan guard 5. The casing 10 has the opening portion 1*a* of the air passage formed in the front panel 1. The fan guard 5 includes the plurality of vertical rails 5*b* and the plurality of horizontal rails 5*a* that are combined with each other, and is configured to cover the opening portion 1*a*. The fan guard 5 includes the upper locking portion 5*b*4 and the lower locking portions 5*b*2. The upper locking portion 5*b*4 is formed on the upper end portion 5*b*9 of the first vertical rail 5*b*1 at one position at the center among the vertical rails 5*b*, or is formed on each of the upper end portions 5*b*9 of two first vertical rails 5*b*1 located so as to be separated away from each other in the right-and-left direction of the casing 10 among the first vertical rails 5*b*1. The lower locking portions 5*b*5 are formed on lower end portions 5*b*7 of a plurality of second vertical rails 5*b*2 located so as to be separated away from each other in the right-and-left direction of the casing 10 among the second vertical rails 5*b*2. The upper locking portion 5*b*4 is formed by bending the upper end portion 5*b*9 toward the casing 10 so as to be inclined in the downward direction. The lower locking portions 5*b*5 are formed by bending the lower end portions 5*b*7 toward the casing 10, and the lower-locking-portion distal end portions 5*b*10 being the portions on the distal ends of the lower locking portions 5*b*5 are bent so that the distal ends are directed in the downward direction. The front panel 1 has the upper temporary fixing hole 1*b* and the lower temporary fixing holes 1*c*. The upper temporary fixing hole 1*b* is configured to receive the upper locking portion 5*b*4 to be inserted thereinto and restrict movement of the fan guard 5 in the forward direction. The lower temporary fixing holes 1*c* are configured to receive the lower locking portions 5*b*5 to be inserted thereinto and restrict movement of the fan guard 5 in the forward direction and the downward direction.

With this configuration, in the outdoor unit 100 for an air-conditioning apparatus, the fan guard 5 can be temporarily fixed to the front panel 1 during assembly. Further, the lower locking portions 5*b*5 can be inserted through the lower temporary fixing holes 1*c* from obliquely above. Thus, when the lower locking portions 5*b*5 are to be inserted through the lower temporary fixing holes 1*c*, work can be performed while visually recognizing the lower temporary fixing holes 1*c* from above, and hence insertion is easy. Further, the lower locking portions 5*b*5 are restricted in movement in the forward direction and the downward direction by the lower temporary fixing holes 1*c*. Thus, the fan guard 5 is assembled while being turned from the front side to the rear side of the casing 10 with the lower locking portions 5*b*5 being the support points, and the position of the upper locking portion 5*b*4 relative to the upper temporary fixing hole 1*b* is easily determined. Therefore, the upper locking portion 5*b*4 is easily inserted into the upper temporary fixing hole 1*b*, thereby facilitating assembly work for the fan guard 5.

(2) In the outdoor unit 100 for an air-conditioning apparatus according to Embodiment 1, the upper temporary fixing hole 1*b* is opened so as to be directed toward the front side of the casing 10.

With this configuration, in the outdoor unit 100 for an air-conditioning apparatus, the upper end portion 5*b*9 of the fan guard 5 can easily be temporarily fixed to the front panel 1 only by pushing the upper locking portion 5*b*4 into the upper temporary fixing hole 1*b*.

(3) In the outdoor unit 100 for an air-conditioning apparatus according to Embodiment 1, the upper temporary fixing hole 1*b* has the cylindrical portion 1*k* formed on the edge portion 1*g* of the upper temporary fixing hole 1*b* so as to be upright from a front surface of the casing 10 toward the inner side of the casing 10.

With this configuration, the strength and the stiffness of the periphery of the upper temporary fixing hole 1*b* are increased. Moreover, when the upper locking portion 5*b*4 is to be inserted into the upper temporary fixing hole 1*b*, deformation of the upper temporary fixing hole 1*b* can be prevented. Further, the stiffness of the periphery of the upper temporary fixing hole 1*b* is high, and hence the periphery of the upper locking portion 5*b*4 of the fan guard 5 is easily warped when the upper locking portion 5*b*4 is brought into abutment with the periphery of the upper temporary fixing hole 1*b* so that the upper locking portion 5*b*4 is easily inserted into the upper temporary fixing hole 1*b*.

(4) In the outdoor unit 100 for an air-conditioning apparatus according to Embodiment 1, the upper temporary fixing hole 1*b* has the curved surface continuous from the front surface 1*h* of the front panel 1 to the cylindrical portion 1*k*.

With this configuration, when the upper locking portion 5*b*4 is inserted into the upper temporary fixing hole 1*b*, the distal end 5*b*12 of the upper locking portion 5*b*4 is inserted along the curved surface. Thus, a force required for the insertion can be reduced, thereby facilitating the temporary fixing work for the fan guard 5.

(5) In the outdoor unit 100 for an air-conditioning apparatus according to Embodiment 1, the lower temporary fixing holes 1*c* are opened upward.

(6) In the outdoor unit 100 for an air-conditioning apparatus according to Embodiment 1, the lower edge portion of each of the lower temporary fixing holes 1*c* located on the lower side in the front panel 1 is located on the front surface side of the casing 10 relative to the upper edge portion 1*q* of each of the lower temporary fixing holes 1*c* located on the upper side in the front panel 1.

With the configurations of the above-mentioned items (5) and (6), in the outdoor unit 100 for an air-conditioning apparatus, the edge portion of the opening of each of the lower temporary fixing holes 1*c* extends in the front-and-rear direction of the casing 10, and the opening is directed upward. Therefore, the lower locking portions 5*b*5 of the fan guard 5 can be inserted into the lower temporary fixing holes 1*c* from above. Thus, work can be performed while visually recognizing the lower temporary fixing holes 1*c* from above the casing 10, thereby facilitating the work.

(7) In the outdoor unit 100 for an air-conditioning apparatus according to Embodiment 1, the fan guard 5 has the bolt insertion portion 5*b*6 through which the bolt 9 for fixing the fan guard 5 to the upper portion of the front panel 1 is inserted. The front panel 1 has the bolt hole 1*e* with which the bolt 9 is screwed. With this configuration, work for fastening the bolt 9 can be performed after the fan guard 5 is temporarily fixed to the front panel 1. The bolt 9 is to be fastened on the upper portion of the casing 10, and hence an operator can perform the fastening work without the need of stooping down.

(8) In the outdoor unit 100 for an air-conditioning apparatus according to Embodiment 1, the third vertical rail 5*b*3 on which the lower locking portion 5*b*5 is not formed has the abutment portion 5*b*8 formed on the lower end portion 5*b*7 of the third vertical rail 5*b*3 so as to be held in abutment with the front surface 1*h* of the front panel 1. The lower-locking-portion distal end portions 5*b*10 are held in abutment with the portions of the lower temporary fixing holes 1*c* on the front side of the casing 10 to apply forces acting in opposite directions between the abutment portions 5*b*8 and the lower-locking-portion distal end portion 5*b*10 to fan guard 5.

With this configuration, although the lower portion of the fan guard 5 is not fixed with the bolt 9, movement of the fan guard 5 in the front-and-rear direction is restricted. Thus, during an operation of the outdoor unit 100, movement of the fan guard 5 relative to the front panel 1 in the front-and-rear direction is restricted, thereby being capable of preventing generation of noise due to vibration. Further, the temporary fixing of the fan guard 5 to the casing 10 during assembly work can easily be performed while achieving restraint of the lower portion of the fan guard 5 so that generation of noise can be prevented.

(9) In the outdoor unit 100 for an air-conditioning apparatus according to Embodiment 1, the fan guard 5 has the coating film formed on the front surface thereof, and the curved surface of the distal end 5*b*12 of the upper locking portion 5*b*4 is formed by being covered with the coating film.

With this configuration, when the upper locking portion 5*b*4 is to be inserted into the upper temporary fixing hole 1*b*, the distal end 5*b*12 of the upper locking portion 5*b*4 can be prevented from damaging the front surface 1*h* of the front panel 1. With this configuration, the coating film on the front panel 1 can be prevented from being peeled off. Thus, corrosion on the front panel 1 is prevented during use of the outdoor unit 100 so that durability of the front panel 1 is not impaired.

REFERENCE SIGNS LIST

1 front panel 1*a* opening portion 1*b* upper temporary fixing hole

1*c* lower temporary fixing hole 1*d* fan-guard mounting portion 1*e* bolt hole

1*f* curved surface 1*g* edge portion 1*h* front surface 1*k* cylindrical portion 1*m* protruding portion 1*n* groove 1*p* lower edge portion 1*q* upper edge portion 2 side panel 3 top panel 4 fan 5 fan guard

5*a* horizontal rail 5*b* vertical rails 5*b*1 first vertical rail 5*b*10 lower-locking-portion distal end portion 5*b*11 horizontal portion 5*b*12 distal end

5*b*2 second vertical rail 5*b*3 third vertical rail 5*b*4 upper locking portion

5*b*5 lower locking portion 5*b*6 bolt insertion portion 5*b*7 lower end portion 5*b*8 abutment portion 5*b*9 upper end portion 6 rear panel 6*a* air inlet 7 fixing member 8 motor 9 bolt 10 casing 15 heat exchanger 100 outdoor unit

The invention claimed is:

1. An outdoor unit for an air-conditioning apparatus, comprising:

a casing having an opening portion of an air passage formed in a front panel; and a fan guard including a plurality of vertical rails extending in a vertical direction of the casing and a plurality of horizontal rails extending in a horizontal direction of the casing, the vertical and horizontal rails being combined with each other and configured to cover the opening portion, each vertical rail of the plurality of vertical rails having an upper end portion and a lower end portion that are bent towards the casing, wherein the plurality of vertical rails of the fan guard includes:

first vertical rails and second vertical rails that are separated from each other in the horizontal direction (a right-and-left direction) of the casing, and the first vertical rails being arranged closer to a center of the fan and the second vertical rails being arranged on an outer side of the first rails relative to the center of the fan, the upper end portions of the first vertical rails each includes an upper locking p formed by bending the upper end portion toward the casing and to be inclined in a downward direction, the lower end portions of the second vertical rails include lower locking portions and lower-locking-portion distal end portions extending in a downward direction that are formed by bending a lower part of the lower end portions of the second vertical rails so that distal ends of the lower locking portions are directed in the downward direction, and wherein the front panel has:

upper temporary fixing holes configured to receive the upper locking portions and to thereby restrict movement of the fan guard in a forward direction, the upper temporary fixing holes each include an opening formed in a flat area of a flat surface of the casing and a cylindrical portion extending perpendicularly from an edge portion of the opening in the front surface of the casing toward an inner side of the casing, and lower temporary fixing holes configured to receive the lower locking portions and to thereby restrict movement of the fan guard in the forward direction and the downward direction.

2. The outdoor unit for an air-conditioning apparatus of claim 1, wherein the upper temporary fixing holes each have a curved surface extending between the front surface of the front panel and the cylindrical portion.

3. The outdoor unit for an air-conditioning apparatus of claim 1, wherein the lower temporary fixing holes include an upward-facing opening configured to receive the locking-portion distal end portions positioned above the lower temporary fixing holes.

4. The outdoor unit for an air-conditioning apparatus of claim 1, wherein the lower temporary fixing holes each includes a lower edge portion located in the front panel on a front side of the casing relative to an upper edge portion located above the lower edge portion, the upper edge portion being located behind the front panel and on an inner side of the casing relative to the lower edge portion.

5. The outdoor unit for an air-conditioning apparatus of claim 1, wherein the fan guard has a bolt insertion portion through which a bolt for fixing the fan guard to an upper portion of the front panel is inserted, and the front panel has a bolt hole into which the bolt is screwed.

6. The outdoor unit for an air-conditioning apparatus of claim 1, wherein the plurality of vertical rails includes third vertical rails, each third vertical rail including an abutment portion formed by bending a lower part of the lower end portions of the third vertical rails that abut the front surface of the front panel, and the fan guard is held in place by opposing forces created by at least the lower-locking-portion distal end portions abutting an inner surface of the front side of the casing adjacent the lower temporary fixing holes and by the abutment portions abutting the front surface of the front panel.

7. The outdoor unit for an air-conditioning apparatus of claim 1, wherein the fan guard has a coating film formed on the front surface thereof, and a curved surface of a distal end of the upper locking portion is covered with the coating film.

8. An outdoor unit for an air-conditioning apparatus, comprising:

a casing having an opening portion of an air passage formed in a front panel; and a fan guard including a plurality of vertical rails extending in a vertical direction of the casing and a plurality of horizontal rails extending in a horizontal direction of the casing, the vertical and horizontal rails being combined with each other and configured to cover the opening portion, each of the plurality of vertical rails having an upper end portion and a lower end portion that are bent towards the casing, wherein the plurality of vertical rails of the fan guard includes:

at least one first-vertical rail and second vertical rails that are separated from each other in the horizontal direction (a right-and-left direction) of the casing, and the at least one first vertical rail being arranged closer to a center of the fan and the second vertical rails being arranged on an outer side of the first rails relative to the center of the fan, the upper end portions of the at least one first vertical rail includes an upper locking portion formed by bending the upper end portion toward the casing and to be inclined in a downward direction, the lower end portions of the second vertical rails include lower locking portions and lower-locking-portion distal end portions extending in a downward direction that are formed by bending a lower part of the lower end portions of the second vertical rails so that distal ends of the lower locking portions are directed in the downward direction, and wherein the front panel has:

an upper temporary fixing hole configured to receive the upper locking portion and to thereby restrict movement of the fan guard in a forward direction, lower temporary fixing holes configured to receive the lower locking portions and to thereby restrict movement of the fan guard in the forward direction and the downward direction, and the lower temporary fixing holes each includes a lower edge portion located in the front panel on a front surface side of the casing relative to an upper edge portion located above the lower edge portion, the upper edge portion being located behind the front panel and on an inner side of the casing relative to the lower edge portion.

9. The outdoor unit for an air-conditioning apparatus of claim 8, wherein the fan guard has a bolt insertion portion through which a bolt for fixing the fan guard to an upper portion of the front panel is inserted, and the front panel has a bolt hole into which the bolt is screwed.

10. The outdoor unit for an air-conditioning apparatus of claim 8, wherein the plurality of vertical rails includes third vertical rail, each third vertical rail including an abutment portion formed by bending a lower part of the lower end portions of the third vertical rails that abut the front surface of the front panel, and the fan guard is held in place by opposing forces created by at least the lower-locking-portion distal end portions abutting an inner surface of the front side of the casing adjacent the lower temporary fixing holes and by the abutment portions abutting the front surface of the front panel.

11. The outdoor unit for an air-conditioning apparatus of claim 8, wherein the fan guard has a coating film formed on the front surface thereof, and the fan guard has a coating film formed on a front surface thereof, the upper end portions of the first vertical rails each includes an upper locking portion formed by bending the upper end portion toward the casing and to be inclined in a downward direction, the upper locking portion having a distal end with a curved surface and being covered with the coating film, the lower end portions of the second vertical rails include lower locking portions and lower-locking-portion distal end portions extending in a downward direction that are formed by bending a lower part of the lower end portions of the second vertical rails so that distal ends of the lower locking portions are directed in the downward direction, and wherein the front panel has:

upper temporary fixing holes configured to receive the upper locking portions and to thereby restrict movement of the fan guard in a forward direction, and lower temporary fixing holes configured to receive the lower locking portions and to thereby restrict movement of the fan guard in the forward direction and the downward direction.

12. The outdoor unit for an air-conditioning apparatus of claim 8, wherein the upper temporary fixing hole includes an opening formed in a flat area of a flat a curved surface of a distal end of the upper locking portion is covered with the coating film.

13. The outdoor unit for an air-conditioning apparatus of claim 12, wherein the upper temporary fixing hole has a curved surface extending between the front surface of the front panel and the cylindrical portion.

14. The outdoor unit for an air-conditioning apparatus of claim 8, wherein the lower temporary fixing holes include an upward-facing opening configured to receive the locking-portion distal end portions positioned above the lower temporary fixing holes.

15. The outdoor unit for an air-conditioning apparatus of claim 8, wherein the lower temporary fixing holes each includes a lower edge portion located in the front panel on a front side of the casing relative to an upper edge portion located above the lower edge portion, the upper edge portion being located behind the front panel and on an inner side of the casing relative to the lower edge portion.

16. An outdoor unit for an air-conditioning apparatus, comprising:

a casing having an opening portion of an air passage formed in a front panel; and a fan guard including a plurality of vertical rails extending in a vertical direction of the casing and a plurality of horizontal rails extending in a horizontal direction of the casing, the vertical and horizontal rails being combined with each other and configured to cover the opening portion, each vertical rail of the plurality of vertical rails having an upper end portion and a lower end portion that are bent towards the casing, wherein the plurality of vertical rails of the fan guard includes:

first vertical rails and second vertical rails that are separated from each other in the horizontal direction (a right-and-left direction) of the casing, and the first vertical rails being arranged closer to a center of the fan and the second vertical rails being arranged on an outer side of the first rails relative to the center of the fan, surface of the casing and a cylindrical portion extending perpendicularly from an edge portion of the opening in the front surface of the casing toward an inner side of the casing.

* * * * *